United States Patent [19]

Allenbaugh

[11] Patent Number: 4,492,397

[45] Date of Patent: Jan. 8, 1985

[54] ADJUSTABLE STRIKE

[75] Inventor: Howard M. Allenbaugh, Fountain Valley, Calif.

[73] Assignee: M.A.G. Engineering & Manufacturing Co., Inc., Gardena, Calif.

[21] Appl. No.: 314,561

[22] Filed: Oct. 26, 1981

[51] Int. Cl.[3] ..... E05C 13/00

[52] U.S. Cl. ..... 292/341.18

[58] Field of Search ..... 292/341.18, 341.19, 292/340

[56] References Cited

U.S. PATENT DOCUMENTS

| | | | |
|---|---|---|---|
| 852,553 | 5/1907 | Georgenson et al. | 292/341.19 |
| 872,053 | 11/1907 | Christy | 292/341.18 |
| 1,214,227 | 1/1917 | Schurenk | 292/341.19 |
| 2,403,182 | 7/1946 | Leary et al. | 292/341.18 |
| 2,592,274 | 4/1952 | Groeger | 292/341.18 X |
| 2,695,807 | 11/1954 | Bissot | 292/341.18 |
| 2,781,219 | 2/1957 | Bahorik | 292/341.18 |
| 2,793,754 | 7/1957 | Russell | 292/341.18 |
| 3,454,295 | 7/1969 | Schlage et al. | 292/341.18 |
| 4,171,836 | 10/1979 | St. Aubin | 292/341.18 |

FOREIGN PATENT DOCUMENTS 707949 4/1965 Canada .

*Primary Examiner*—Richard E. Moore
*Attorney, Agent, or Firm*—Pretty Schroeder Brueggemann & Clark

[57] ABSTRACT

A strike plate has a center section with an aperture for receiving a bolt or latch, and upper and lower sections, disposed on opposite sides of the center section, that include interlock surfaces and horizontally elongated slots for receiving screws. Upper and lower keeper plates have corresponding interlock surfaces that engage those of the strike plate in a selected position to prevent movement of the strike plate. The keeper plates have round screw holes that can be aligned with the slots of the strike plate. Preferably, the interlock surfaces are formed by contiguous, V-shaped, vertically extending grooves.

6 Claims, 7 Drawing Figures

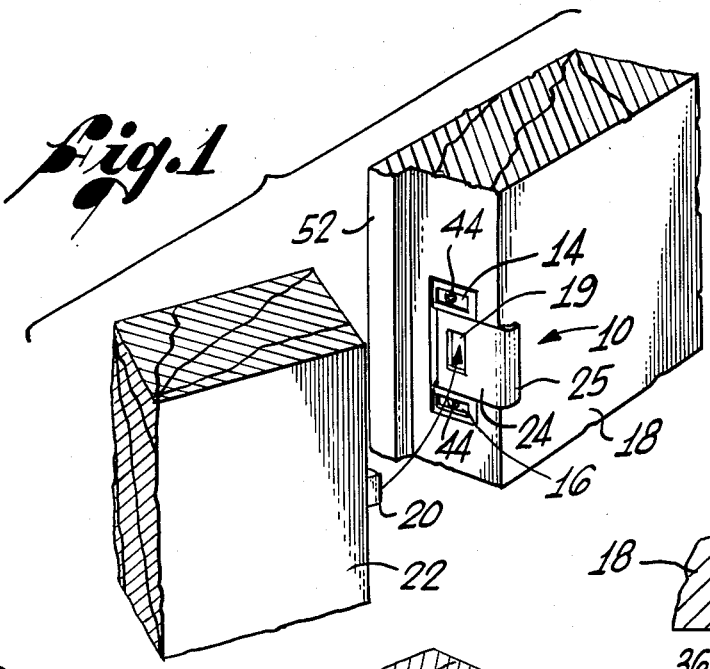
Fig. 1
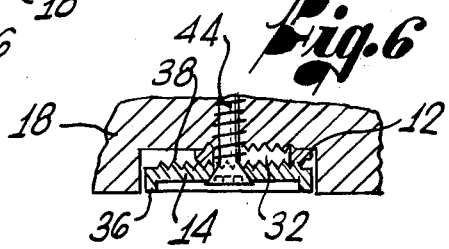
Fig. 6
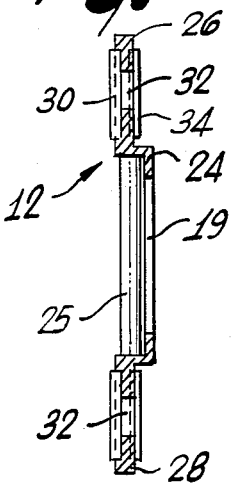
Fig. 7
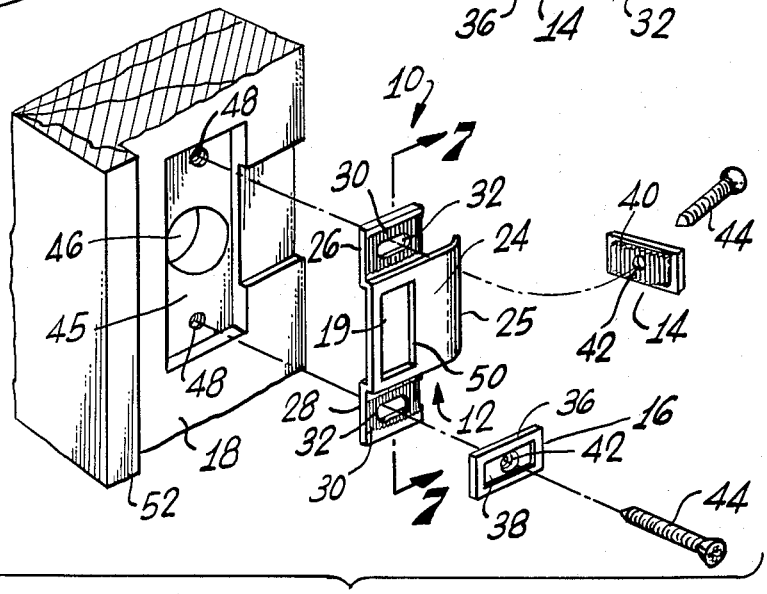
Fig. 2
Fig. 3
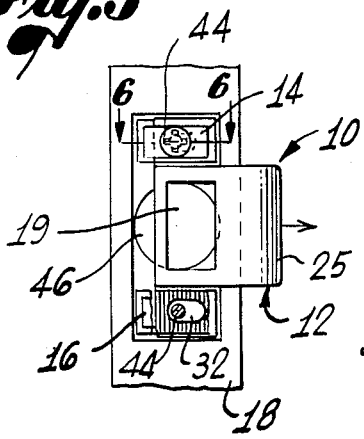
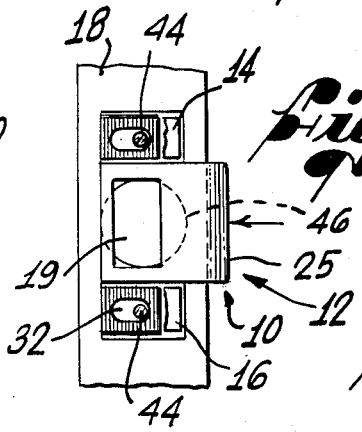
Fig. 4
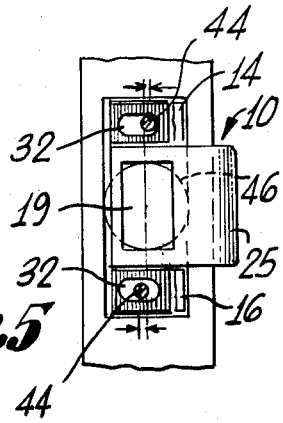
Fig. 5

ADJUSTABLE STRIKE

FIELD OF THE INVENTION

The present invention relates to a strike to be mounted on a doorjamb and having an aperture to receive a lock bolt or latch, and, more particularly, to a strike that permits the aperture to be adjustably positioned.

BACKGROUND OF THE INVENTION

A conventional door lock, whether of the latch or dead bolt tape, requires that a cooperating strike be mounted on the doorjamb to receive the latch or bolt. The most common arrangement uses a simple stamped elongated metal plate with an aperture of suitable size and shape. Two holes, located above and below the aperture, permit the strike to be secured to the doorjamb by mounting screws.

If the strike is to coact with the lock in a satisfactory manner, it must be positioned with considerable accuracy. The most critical parameter in positioning the strike is the location of the vertical edge of the aperture that is farthest from the stop of the doorjamb. This edge must engage the latch or bolt so as to hold the door firmly against the stop without permitting the door to rattle. If the edge is too close, however, the aperture will not readily receive the bolt or latch when the door is closed.

The failure of door locks to work together as intended is frequently attributable to the difficulty in accurately drilling the holes in the doorjamb to receive the mounting screws, the aperture often being too close to the stop or too far away. Moreover, the holes may not be vertically aligned and may not be spaced apart by the correct distance to mount the strike in any position. Even if the holes are drilled in the proper position, bowing of the door can cause misalignment later. Settling of the building over a period of time frequently dislocates and misaligns the strike. Although the horizontal position of the aperture is the most critical, vertical misalignment can also cause serious problems and is most likely to occur as a result of "door sag" which accompanies settling. An existing hole that is out of position usually makes it difficult or impossible to drill a new hole at the proper location since the new hole position often overlaps the old hole.

There is, therefore, a recognized need for a strike that permits the position of the bolt or latchreceiving aperture to be adjusted with reference to the positions of the screw holes in the doorjamb. It is an objective of the present invention to provide such a strike.

SUMMARY OF THE INVENTION

The present invention resides in an adjustable strike that includes a strike plate having an aperture therein that receives a bolt or latch. The strike plate has upper and lower interlock surfaces above and below the aperture and horizontally elongated screw slots, also above and below the aperture. Separate upper and lower keeper plates are also included, each having a screw hole and an interlock surface that is configured to mate with the interlock surfaces of the strike plate. The keeper plates can be engaged and interlocked with the strike plate in a plurality of positions, each with the screw hole of the keeper plate in alignment with one of the slots of the strike plate.

Preferably, the interlock surfaces are formed by elongated vertical grooves. These grooves may be of a symmetrical V-shaped configuration. It is desirable that the interlock surfaces of the strike plate have a greater vertical dimension then those of the keeper plates, thus permitting the strike plate to have a range of vertical adjustment.

It is advantageous to form the strike plate so that it has grooved back surfaces corresponding to the interlock surfaces but on the opposite side of the plate. These back surfaces engage the doorjamb directly and tend to resist movement of the strike plate.

The preferred configuration of the strike plate employs a raised center section by which the aperture is defined and has recessed upper and lower sections that carry the interlock surfaces.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a fragmentary perspective view of a door and doorjamb, the door being slightly ajar and the doorjamb being equipped with an adjustable strike constructed in accordance with the present invention;

FIG. 2 is a perspective exploded view of the doorjamb and adjustable strike of FIG. 1;

FIGS. 3, 4 and 5 are front views of the adjustable strike, illustrating various combinations of positions of the keeper plates relative to the strike plate, the keeper plates being partially broken away FIG. 6 is a cross-sectional view of the strike plate, one of the keeper plates and a fragmentary portion of the doorjamb taken as indicated by the line 6—6 in FIG. 2; and FIG. 7 is a cross-sectional view of the strike plate taken as indicated by the line 7—7 in FIG. 2.

DESCRIPTION OF THE PREFERRED EMBODIMENT

An adjustable strike 10 that exemplifies the present invention, shown in FIGS. 1–7, includes a strike plate 12 and upper and lower keeper plates 14 and 16. It is mounted on a doorjamb 18 and defines a rectangular aperture 19 that receives a latch 20 (or a bolt) that protrudes from the edge of a door 22 (see FIG. 1).

The strike plate 12 is a stamped metal member that has a raised center section 24 defining the aperture 19. A lip 25 extends from the aperture 19 and is wrapped around the edge of the jamb 18 to deflect the latch 20 inwardly when the door 22 is closed. An upper section 26 and a lower section 28 of the plate 12 are recessed and depend from the center section 24. Outwardly facing interlock surfaces 30 are formed on the upper and lower sections 26 and 28, each of these surfaces being generally rectangular, extending completely across the strike plate 12 and being centrally interrupted by an elongated horizontal slot 32. The interlock surfaces 30 are formed by contiguous, V-shaped, vertically extending grooves. Each groove is symmetrical, the two sides being disposed at the same angle to the principal plane of the strike plate 12. On the opposite side of the upper and lower sections 26 and 28 (the side that faces the doorjamb 18) are back surfaces 34 of the same grooved configuration as the interlock surfaces 30. The interlock and back surfaces 30 and 34 are formed by the same stamping or coining operation and, in fact, better groove definition can be achieved by forming both surfaces simultaneously in this manner.

The keeper plates 14 and 16 are of the same construction and are interchangeable. They are slightly wider than the strike plate 12. Each includes a raised perimeter 36 and a recessed rectangular center section 38 (see FIG. 6). The back side of the center section 38 forms an interlock surface 40 that has a configuration corresponding to that of the strike plate interlock surfaces 30. Because of the recess or offset of the center section 38, good groove definition can be obtained despite the fact that only one side of each keeper plate 26, 28 is formed in this manner.

At the center of each keeper plate 26, 28 is a round, counter-sunk screw hole 42. These holes 42 are just large enough to receive a pair of mounting screws 44 by which the strike 10 is attached to the jamb 18. The diameter of the holes 42 is smaller than the vertical dimension of the slots 32.

When the strike 10 is to be installed, an appropriately shaped recess 45 is cut in the jamb 18, as shown in FIG. 2. The recess 45 should be at least as wide as the keeper plates 14 and 16, and slightly longer than the strike plate 12 in the vertical direction. A relatively large center hole 46 is bored to receive the latch 20. This hole 46 will be larger than the latch 20 and the aperture 19 and will be partially covered by the strike plate 12.

Two mounting holes 48 are drilled to receive the screws 44. These holes 48 are positioned as accurately as possible to place the outer edge 50 of the aperture 19 at the correct distance from a stop 52 carried by the jamb 18.

When the strike plate 12 is positioned in the recess 45, the slots 32 are aligned with the mounting holes 48 in the jamb 18. The strike plate 12 can be moved considerably in the horizontal direction and to a lesser extent in the vertical direction while maintaining the mounting holes 48 within the slots 32.

With the strike plate 12 in the desired position, the keeper plates 14 and 16 are installed so that they engage the upper and lower interlock surfaces 32 of the plate. It should be noted that the interlock surfaces 40 of the keeper plates 14 and 16 can engage and mate with the interlock surfaces 30 of the strike plate 12 in a plurality of horizontally displaced positions. For example, the strike plate 12 can be moved outwardly so that the mounting screws 44 are at the inner ends of the slots 32 (as shown in FIG. 3), or it can be moved inwardly, toward the stop 52, so that the screws are at the outer ends of the slots (as shown in FIG. 4). If the mounting holes 48 are not aligned vertically, the two slots 32 have different relationships to the screws 44 (as shown in FIG. 5).

It is also possible to move the strike plate 12 vertically before the mounting screws 44 have been tightened, this adjustment being possible because the interlock surfaces 40 of the keeper plates 14 and 16 are not as long vertically as those of the strike plate. Once the screws 44 have been tightened, the strike plate 12 is held against movement, particularly vertical movement, by the back surfaces 34 that bite into the jamb 18.

It can be seen that the strike 10 permits adjustment of the position of the aperture 19 to accomodate improper positioning of the holes 48 in any direction. Further adjustment can be made later without redrilling the holes if necessitated by door sag or warpage.

While a particular form of the invention has been illustrated and described, it will be apparent that various modifications can be made without departing from the spirit and scope of the invention.

I claim:

1. An adjustable strike comprising:

a strike plate having an aperture therein to receive a bolt or latch, upper and lower interlock surfaces above and below said aperture, respectively, corresponding upper and lower back surfaces on the opposite side of said strike plate from said interlock surfaces, a plurality of closely spaced parallel vertical grooves on each of said interlock surfaces and said back surfaces, and upper and lower horizontally elongated screw holes above and below said aperture, respectively; and separate and independently movable upper and lower keeper plates each having a screw hole therein and an interlock surface thereon, said interlock surfaces each having a plurality of closely spaced parallel vertical grooves thereon adapted to slidably engage said grooves of said strike plate, said keeper plates being so configured as to align said screw holes thereof with said screw holes of said strike plate while mating said interlock surfaces thereof with said interlock surfaces of said strike plate, whereby said strike plate can be secured to a door jamb in any of a plurality of horizontally and vertically displaced interlock positions relative to said keeper plates with said back surfaces engaging said door jam.

2. The apparatus of claim 1 wherein said screw holes of said keeper plates are round, whereby the position of each of said keeper plates can be determined by the position of a corresponding mounting hole in a doorjamb.

3. The apparatus of claim 1 wherein said strike plate includes a raised center section that defines said aperture and recessed upper and lower sections that carry said interlock surfaces of said strike plate.

4. The apparatus of claim 1 wherein said interlock surfaces of said strike plate have longer vertical dimensions than said keeper plates, thereby permitting vertical adjustment of said strike plate relative to said keeper plates.

5. The apparatus of claim 1 wherein said interlock surfaces of said strike plate have a longer vertical dimension than those of said keeper plates, thereby permitting vertical adjustment of said strike plate relative to said keeper plates.

6. An adjustable strike comprising:

a metal strike plate having a raised center section that defines an aperture for receiving a latch or bolt and recessed upper and lower sections above and below said center section, said upper and lower sections each having a horizontally elongated slot therein for receiving a screw, said upper and lower sections each having interlock surfaces on one side thereof and corresponding back surfaces on the opposite side thereof, said interlock surfaces and said back surfaces each being formed by a series of contiguous, closely spaced, symmetrical, V-shaped, parallel, vertical grooves; and separate and independently movable generally rectangular metal upper and lower keeper plates each having a round screw hole in the center thereof and an interlock surface thereon, said interlock surfaces of said keeper plates being configured to mate with said interlock surfaces of said strike plate, said keeper plates being so configured as to align said screw holes thereof with said slots of said strike plates while said interlock surfaces are mated, whereby said strike plate can be secured to a door jam in a plurality of positions relative to said keeper plates with said back surface engaging said door jam.

* * * * *